US005230500A

United States Patent [19]

Lin

[11] Patent Number: 5,230,500

[45] Date of Patent: Jul. 27, 1993

[54] PITCH ADJUSTABLE WOODEN BALUSTRADE

[76] Inventor: Ta-Chin Lin, No. 8, Lane 4, Pei Jung Street, Chia I, Taiwan

[21] Appl. No.: 915,339

[22] Filed: Jun. 20, 1992

[51] Int. Cl.[5] ..... E04H 17/24

[52] U.S. Cl. ..... 256/67; 256/60; 256/65; 256/22; 403/24

[58] Field of Search ..... 256/65, 67, 60, 59, 256/22, 21; 403/248, 24, 391, 396; 52/507, 690, 663

[56] References Cited

U.S. PATENT DOCUMENTS

| | | | |
|---|---|---|---|
| 444,960 | 1/1891 | Priday | 256/22 |
| 2,150,651 | 3/1939 | Ewing | 256/22 X |
| 2,834,621 | 5/1958 | Schroer | 256/65 X |
| 3,462,021 | 8/1969 | Hawke et al. | 256/59 X |
| 3,741,595 | 6/1973 | Horgan, Jr. | 256/65 X |
| 4,776,719 | 10/1988 | Kreider | 403/24 |

FOREIGN PATENT DOCUMENTS

| | | | |
|---|---|---|---|
| 1006996 | 10/1965 | United Kingdom | 256/59 |

*Primary Examiner*—Randolph A. Reese
*Assistant Examiner*—Harry C. Kim
*Attorney, Agent, or Firm*—Bacon & Thomas

[57] ABSTRACT

A balustrade including a handrail supported on a row of balusters, each of which is attached with two cross bars at different heights, and a plurality of vertical axles respectively connected to the cross bars between each two adjacent balusters by connectors, wherein each connector has a transverse rod on one end respectively and movably inserted into an axial hole on the respective cross bar, and an axle hole on an opposite end at right angle to the axial hole and through which a respective vertical axle is inserted and secured in place by a tapping screw.

2 Claims, 2 Drawing Sheets

FIG. 1
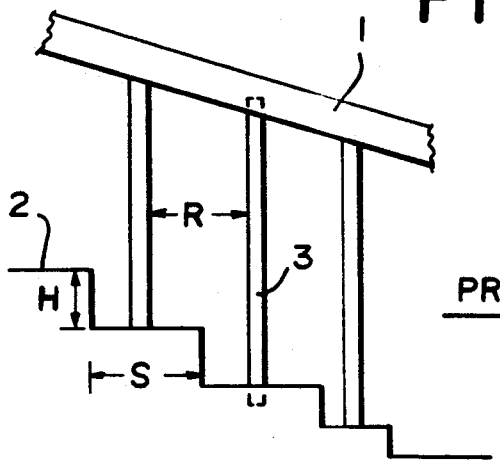
PRIOR ART
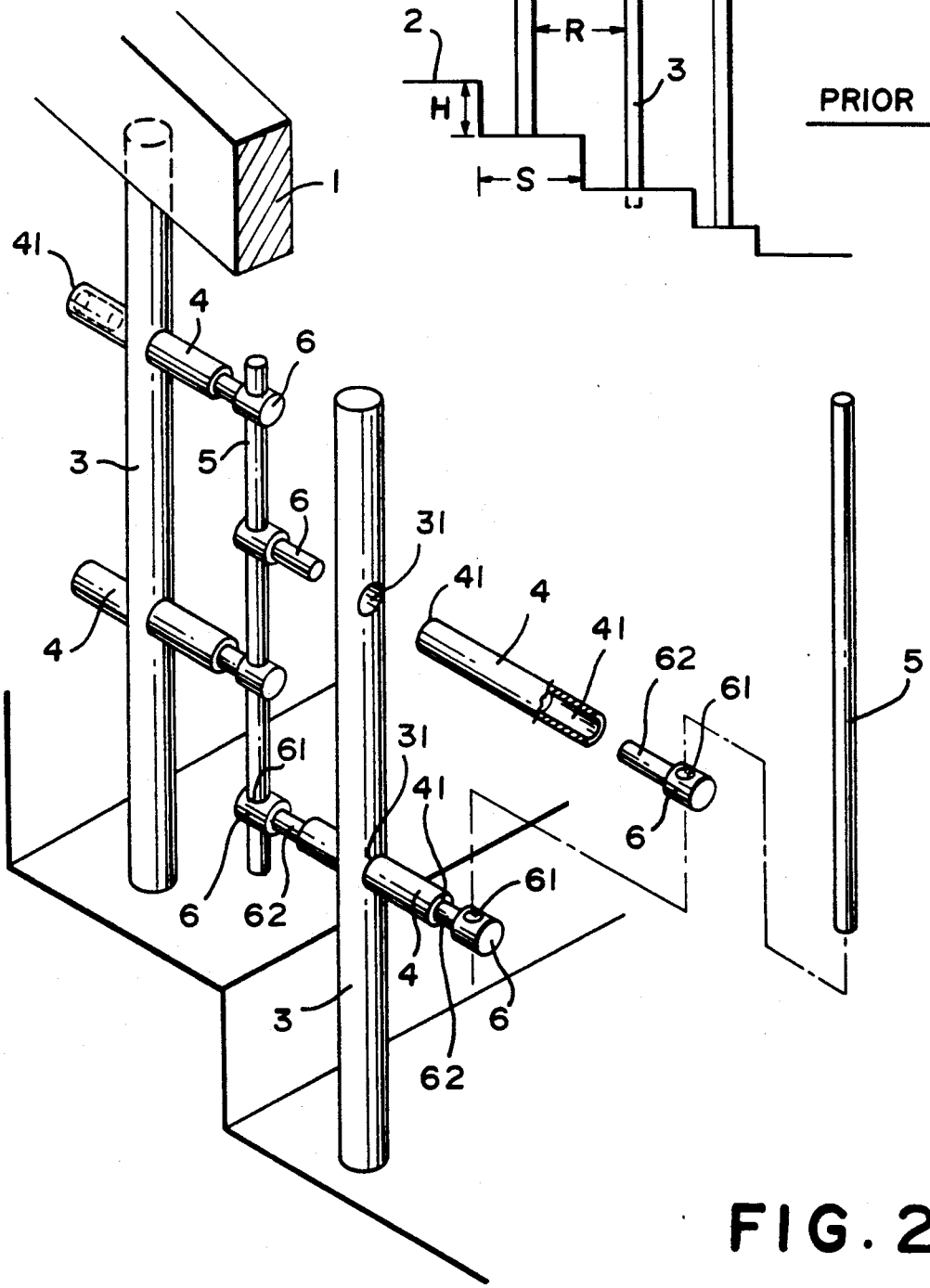
FIG. 2

PITCH ADJUSTABLE WOODEN BALUSTRADE

BACKGROUND OF THE INVENTION

1. Field of the Invention

The present invention relates to balustrades and relates more particularly to a balustrade of which the pitch between each two adjacent balusters can be adjusted.

2. Description of Prior Art

A balustrade is generally comprised of a handrail supported on a row of balusters. When installed, the pitch between each two adjacent balusters of a balustrade is generally not adjustable. Because the balusters of a balustrade are spaced from one another, children may pass through the gap between two adjacent balusters for the fun of it. In order to prohibit children from passing through the gaps in a balustrade, nets and wires may be fastened between two adjacent balusters to form a barrier. However, fastening nets or wires to a balustrade to keep children from passing through the gaps among the balusters also detracts from the original beauty of the balustrade. If the pitch is reduced by adding more balusters, the cost of a balustrade will be greatly increased. Furthermore, increasing the number of balusters will also make the installation difficult. U.S. patent application Ser. No. 07/853/584 discloses a balustrade with adjustable balusters which, invention, eliminates the aforesaid problems. However, this structure of a balustrade with adjustable balusters is not suitable for stairs having different treads.

SUMMARY OF THE INVENTION

The present invention has been accomplished under the aforesaid circumstances. It is therefore an object of the present invention to provide a balustrade which has barrier means to prevent children from passing through the gaps therein. It is another object of the present invention to provide a balustrade having barrier means to prevent children from passing through the gap therein, wherein the barrier means can be adjusted horizontally to match with different sizes of treads.

According to the present invention, vertical axles are respectively suspended between two pairs of cross bars on two adjacent balusters by connectors. Each connector has a transverse rod on one end respectively and movably inserted into an axial hole on the respective cross bar, and an axle hole on an opposite end at right angle through which a respective vertical axle is inserted and secured in place by a tapping screw.

BRIEF DESCRIPTION OF THE DRAWINGS

The foregoing and other objects, features and advantages of the present invention will be best understood from the following description, the appended claims and the accompanying drawings in which:

FIG. 1 illustrates a balustrade installed on a staircase according to the prior art;

FIG. 2 is an installed example according to the present invention with partly exploded view thereof.

DETAILED DESCRIPTION OF THE PREFERRED EMBODIMENT

Figure 3:
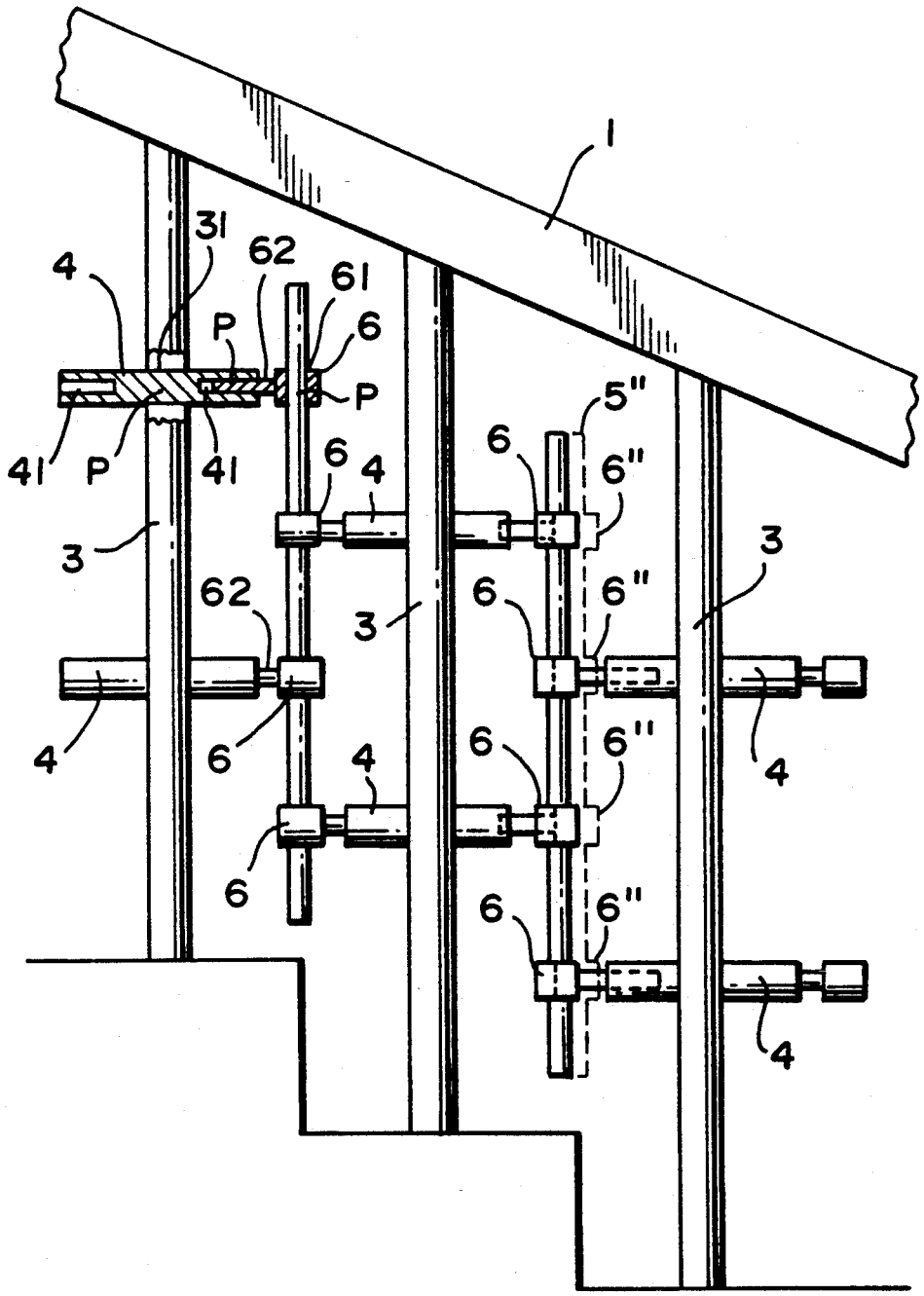
FIG. 3 illustrates the manner in which each vertical axle can be moved horizontally between two adjacent balusters.

A balustrade according to the prior art is shown in FIG. 1 and installed on a staircase 2. The balustrade includes a plurality of balusters 3 which are spaced at a pitch R at different heights on staircase 2. Each step of staircase 2 has a height H and a tread width S. A handrail 1 is supported on the upper ends of balusters 3. The pitch R between adjacent balusters 3 is fixed and defines a spacing which cannot be reduced unless a barrier is disposed between adjacent balusters 3 or additional balusters are added.

Referring to FIGS. 2 and 3, each baluster 3 is secured to a handrail 1 and has two transverse holes 31 at two different levels in for receiving a pair of cross bar 4. A vertical axle 5 can be connected to the cross bars 4 between two adjacent balusters 3 by connectors 6. Each cross bar 4 has two axial holes 41 longitudinally aligned on two opposite ends (in an alternate form, the cross bar 4 may be made from a tube having a bore through the longitudinal axis thereof) for fastening a connector 6. Each connector 6 has a transverse rod 62 on one end inserted into either axial hole 41 on either cross bar 4 and secured thereto by a screw P, and an axle hole 61 on an opposite end at a right angle to axle hole 61 through which a vertical axle 5 is inserted. After respective vertical axles 5 have been connected to the cross bars 4 between each two adjacent balusters 3 by respective connectors 6, each connector 6 is fixed to the respective vertical axle 5 by a tapping screw P. After installation, the balusters are treated through a finishing process, and then painted according to the desired colors. By means of the aforesaid arrangement, the gap between each two adjacent balusters 3 is divided into several small spaces, and therefore children are prevented from passing through the gap. More particularly, the transverse rod 62 of each connector 6 is allowed to slide in either axial hole 41 on the respective cross bar 4, and therefore, each vertical axle 5 with the attached connectors 6 can be simultaneously displaced laterally toward either adjacent baluster. For example, each vertical axle 5 and the attached connectors 6 can be moved from the real line position to the dotted line position 5'',6'' (see FIG. 3). Therefore, the pitch between each two adjacent balusters can be conveniently adjusted before the installation of the balustrade on staircases 2.

What is claimed is:

1. A balustrade including a hand rail supported on a plurality of spaced balusters of different heights for installation on a staircase, which said balustrade comprises:

a) a plurality of balusters spaced from each other for disposition on said staircase at different heights, each said baluster having a pair of spaced transverse holes formed therethrough;

b) a cross bar disposed through each said transverse holes of the balusters, each said cross bar including two opposite ends extending outwardly from both side of the baluster, and including an axial hole formed in each said opposite end;

c) a plurality of connectors, each said connector including a transverse rod movably inserted into said axial hole and an axle hole disposed at a right angle to the axial hole;

d) a vertical axle positioned between said adjacent balusters and disposed through the axle holes of said plural connectors, means for securing each said vertical axle to the plural connectors; and e) whereby each said vertical axle and its said plural connectors may be laterally displaced toward either said adjacent baluster for adjusting the pitch between the balusters.

2. The balustrade of claim 1 further including means for securing each said connector to each said cross bar.

* * * * *